US006398025B2

(12) United States Patent
Choe

(10) Patent No.: US 6,398,025 B2
(45) **Date of Patent: *Jun. 4, 2002**

(54) UNIVERSALLY USABLE HEAD COVER FOR GOLF CLUBS

(76) Inventor: Jin Tae Choe, San 192, Sampeung APT22-1205, Seocho-Dong, Seocho-Ku, 137-070, Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/365,874

(22) Filed: Aug. 3, 1999

(30) Foreign Application Priority Data

Aug. 3, 1998 (KR) ..... 98-14571

(51) Int. Cl.[7] ..... A63D 55/00
(52) U.S. Cl. ..... 206/315.2; 150/160
(58) Field of Search ..... 150/160; D21/754; 206/315.2

(56) References Cited

U.S. PATENT DOCUMENTS 2,526,985 A * 10/1950 Whitehead ..... 150/160
2,737,394 A * 3/1956 Abel ..... 150/160
3,727,659 A * 4/1973 Shuford ..... 150/160
3,861,434 A * 1/1975 Harding ..... 150/160
4,667,716 A * 5/1987 Solheim et al. ..... 150/160
5,099,898 A * 3/1992 Miller ..... 150/160
5,769,141 A * 6/1998 Rinehard ..... 150/160
D402,728 S * 12/1998 Stutzman ..... D21/754
6,053,071 A * 4/2000 Vazquez, Jr. ..... 150/155 X

* cited by examiner

*Primary Examiner*—Stephen P. Garbe
*Assistant Examiner*—Tri M. Mai
(74) *Attorney, Agent, or Firm*—McDermott, Will & Emery

(57) ABSTRACT

A head cover capable of being used for receiving golf clubs of various kinds and various sizes, is disclosed. The head cover for golf clubs of this invention comprises a head protection part. The head protection part consists of an outer layer defining a cavity therein and a liner provided within the cavity to define a head pocket for receiving the head of a golf club therein. The liner consists of upper and lower parts, the upper and lower parts of the liner being integrated into a single structure with an elastic band loop interposed between the upper and lower parts. The head cover for a golf club of this invention covers more securely any kind of or any size of golf club head, is reduced in the production cost, and is convenient to the golfer in use.

1 Claim, 5 Drawing Sheets

UNIVERSALLY USABLE HEAD COVER FOR GOLF CLUBS

BACKGROUND OF THE INVENTION

1. Field of the Invention

The present invention relates, in general, to head covers for golf clubs designed to prevent golf clubs from being damaged and, more particularly, to a head cover capable of being used for receiving golf clubs of various kinds and various sizes.

2. Description of the Prior Art

As well known to those skilled in the art, golf clubs are typically classified into two types; "woods" having large and voluminous heads, and "irons" having smaller and narrower heads. The "woods" are generally used for making long-distance drive shots, while the "irons" are generally used for making short-distance shots.

The "woods" and "irons" are manufactured to be of various sizes. Typically, individual golf clubs, having different sizes and different types, are selected by a golfer while golfing in accordance with physical characteristics of the golfer, landscape, and desired flying distances of golf balls. The "woods" have been typically classified into about five types in accordance with the sizes of the heads. However, in recent days, the head sizes of "woods" further vary in order to meet a golfer's fancy and desired flying distances, thus being classified into ten or more types. When carrying the "woods" and "irons" on a golf course or other areas, a golfer takes a golf bag with the clubs being received in the bag. In such a case, the clubs are positioned within the bag in a way such that the heads are directed upwardly, with the grips being positioned on the bottom of the bag. Therefore, the club heads may undesirably strike against each other, and so the heads, particularly, the heads of the "woods" may be impacted and damaged. In an effort to protect the heads of the "woods" the wood heads from being impacted or damaged, it is preferable to cover them with head covers.

FIGS. 1 to 3 show the construction of conventional head covers for golf clubs. As shown in the drawings, a conventional head cover 1 comprises a head protection part 2, which defines a head pocket 3 for receiving and protecting the head 9 of a club 8. An elongated shaft protection part 7 extends from the bottom of the head protection part 2 to a length and is used for receiving and protecting the shaft of the club 8. In the head cover of FIG. 1, the head protection part 2 and the shaft protection part 7 are integrally formed through a knitting process using elastic yarns. In the head cover of FIG. 2, the outer layer of the head protection part 2 is made of woven fabric or synthetic fabric, with a cushionable sponge 5 being sewn to the interior surface of the woven fabric or synthetic fabric outer layer. Thereafter, the shaft protection part 7 is integrated with the bottom of the head protection part 2 through a sewing process. In the head cover of FIG. 3, a liner 6, integrally extending from the top end of the shaft protection part 7, is positioned within the head protection part 2 so as to somewhat tightly hold the club head 9 within the head protection part 2.

However, the above head covers are problematic in that it is necessary for manufacturers to produce several types of head covers, having various sizes meeting the different head sizes, and for golfers to purchase the head covers at high cost. When the ten or more types of the heads of the "woods" are covered with inappropriately-sized covers respectively, the head covers may be undesirably removed from the heads and fail to effectively protect the wood heads from unexpected impact. In addition, since it is necessary for the manufacturers to produce such several types of covers, productivity while producing the covers is regrettably reduced. This finally results in an increase in the production cost of the head covers. Another problem, experienced in the conventional head covers, resides in that they force a golfer to cover the club heads with the head covers and to remove the covers from the heads one by one, thus being inconvenient to the golfer.

SUMMARY OF THE INVENTION

Accordingly, the present invention has been made keeping in mind the above problems occurring in the prior art, and an object of the present invention is to provide a head cover for golf clubs, more securely covering any kind of or any size of golf club head, reduced in the production cost, and convenient to the golfer in use.

In order to accomplish the above object, the present invention provides a universally usable head cover for golf clubs, comprising: a head protection part consisting of an outer layer and a liner, the outer layer defining a cavity therein and a liner being provided within the cavity to define a head pocket for receiving the head of a golf club therein, the liner consisting of upper and lower parts, the upper and lower parts of the liner being integrated into a single structure with an elastic band loop interposed between the upper and lower parts.

The head cover for golf clubs of this invention comprises further an elongated shaft protection part for receiving a shaft of the golf club, the shaft protection part extending from the bottom end of the liner and being attached to the bottom end of the head protection part at its top end.

The circumferential surface of the liner is divided into a plurality of sections, with the elastic band loop being positioned within at least one of the sections.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
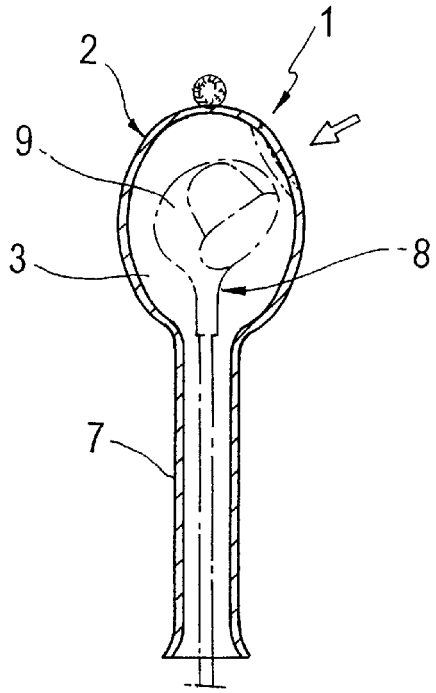
FIG. 1 (PRIOR ART)
FIG. 1 is a longitudinal sectional view, showing a conventional head cover for golf clubs.
Figure 2:
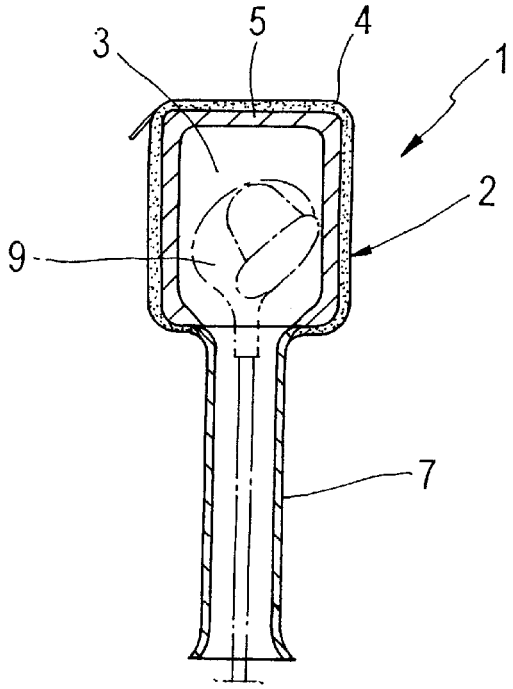
FIG. 2 (PRIOR ART)
FIG. 2 is a longitudinal sectional view, showing another conventional head cover for golf clubs.
Figure 3:
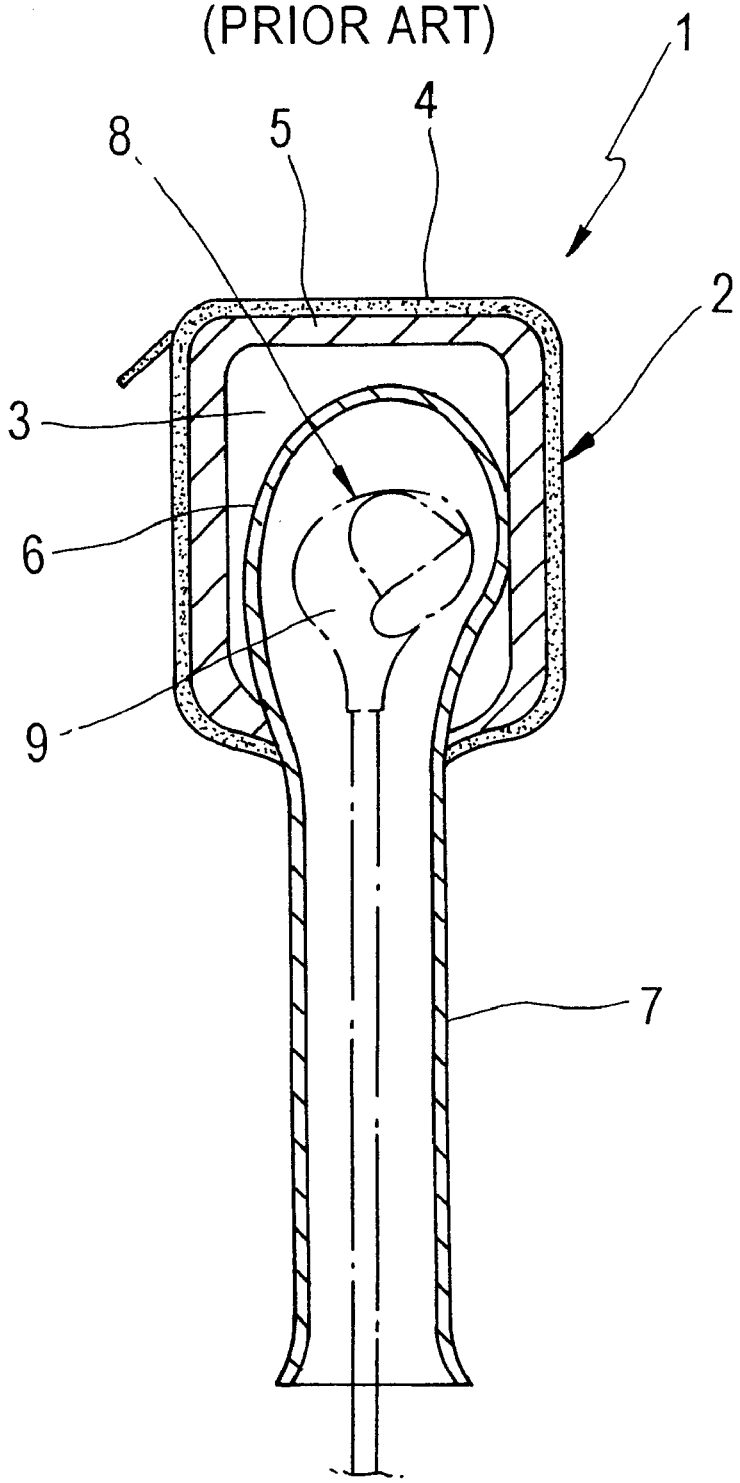
FIG. 3 (PRIOR ART)
FIG. 3 is a longitudinal sectional view, showing a further conventional head cover for golf clubs.
Figure 4:
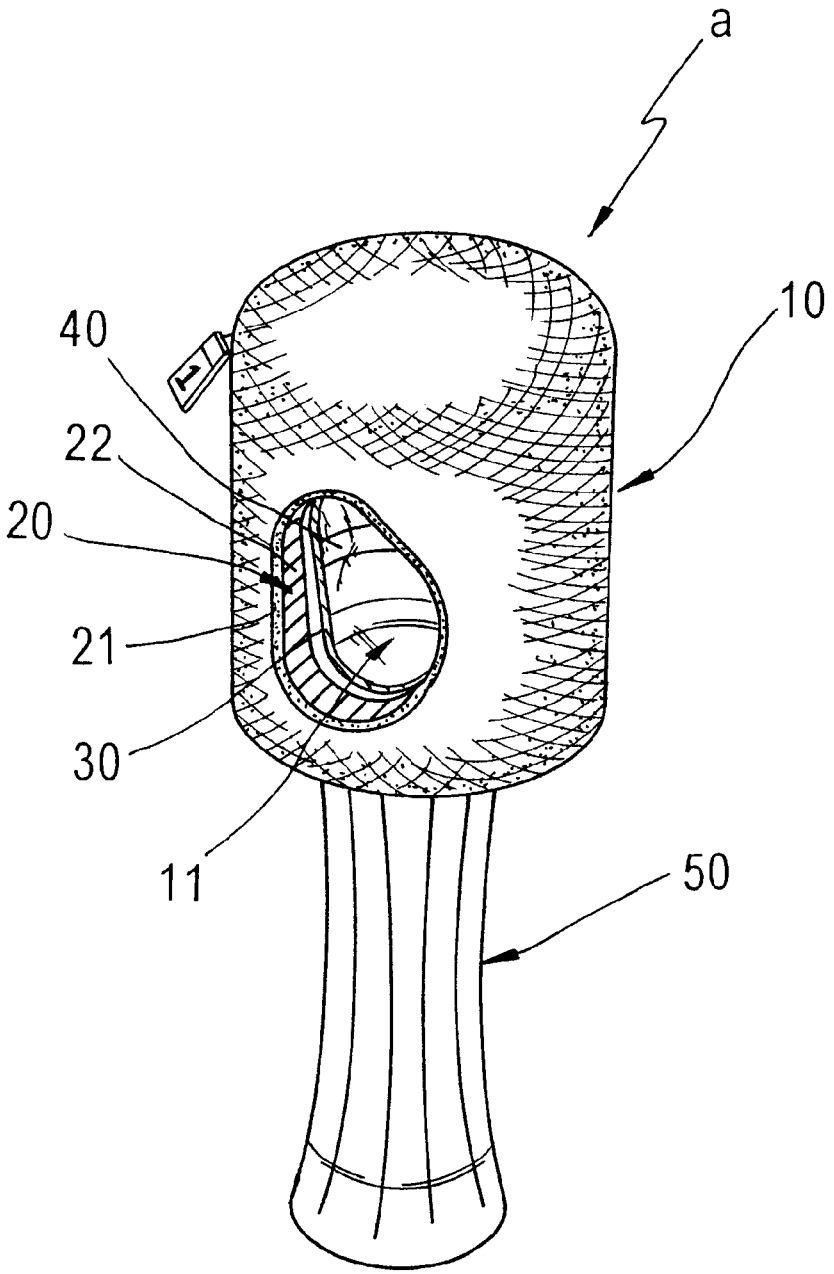
FIG. 4 is a partially cut away perspective view, showing a universally usable head cover for golf clubs according to the preferred embodiment of this invention.
Figure 5:
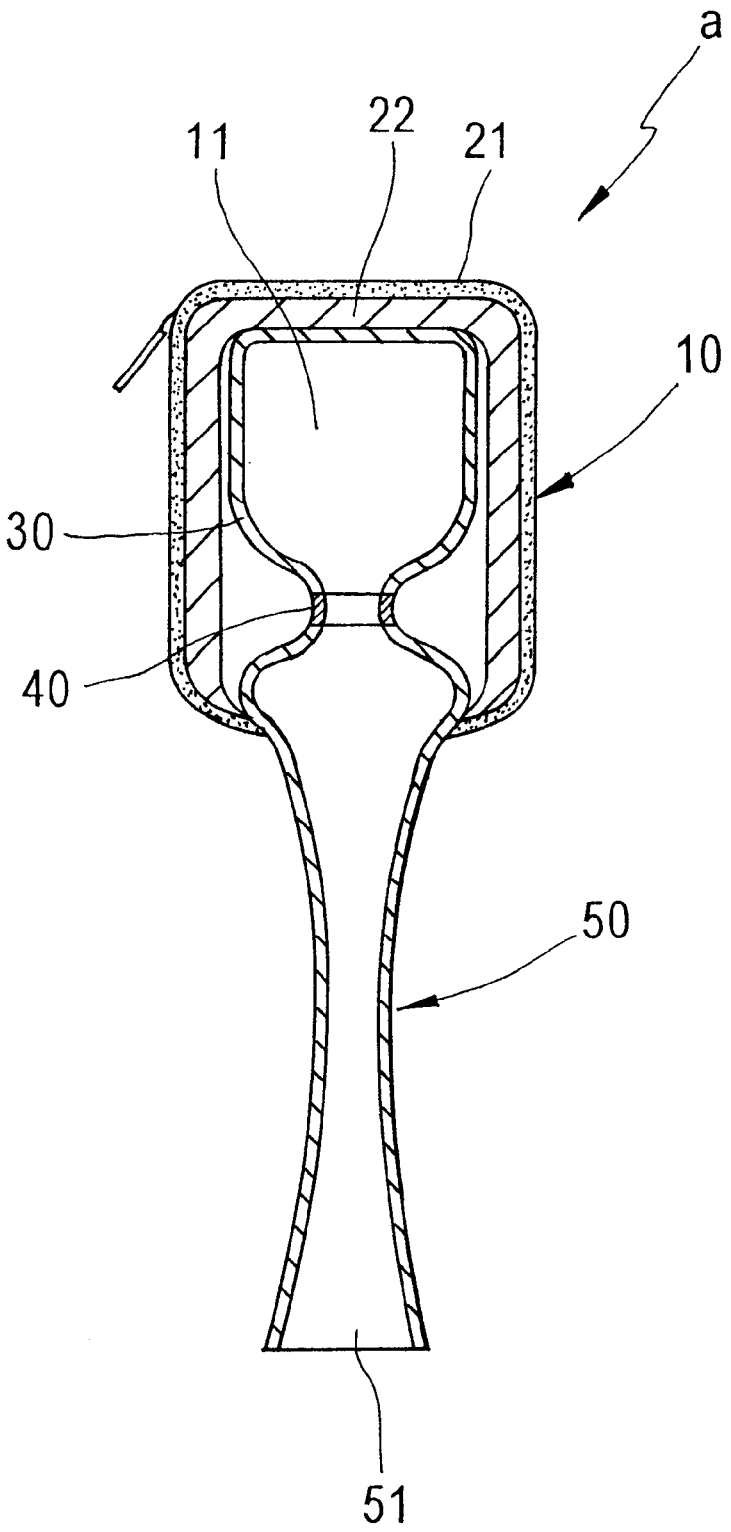
FIG. 5 is a longitudinal sectional view, showing the universally usable head cover of the embodiment.
Figure 6:
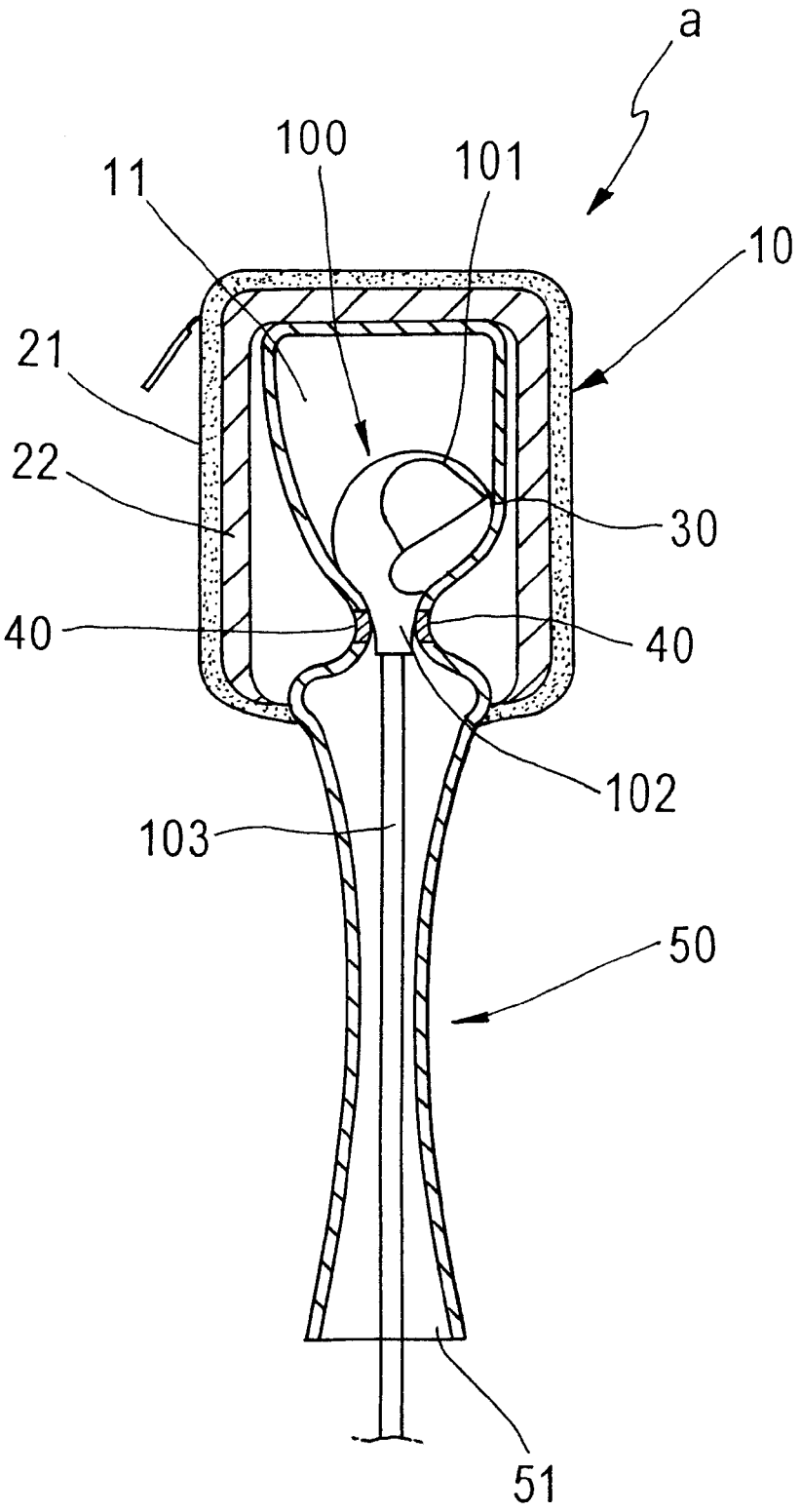
FIG. 6 is a longitudinal sectional view, showing the universally usable head cover of the embodiment in use.

With reference to FIGS. 4, 5, and 6, the construction of a universally usable head cover for golf clubs according to the preferred embodiment of this invention will be described in the following.

FIG. 4 is a partially cut away perspective view, showing a universally usable head cover for golf clubs according to the preferred embodiment of this invention. FIG. 5 is a longitudinal sectional view, showing the universally usable head cover for golf clubs of the embodiment. And, FIG. 6 is a longitudinal sectional view, showing the universally usable head cover for golf clubs of the embodiment in use.

As shown in FIGS. 4–6, a universally usable head cover for golf clubs according to the preferred embodiment of this invention comprises a head protection part 10 and an elongated shaft protection part 50. The head protection part 10 defines a cavity, while the elongated shaft protection part 50 extends from the bottom end of the head protection part 10 to a length.

The head protection part 10 consists of the outer layer 21 and a liner 30.

The outer layer 21 is made of woven fabric or synthetic fabric, with a cushionable sponge 22 being sewn to the interior surface of the woven fabric or synthetic fabric outer layer 21. In addition, an identification tag (not shown) for identifying the type and/or size of the golf club 100 may be attached to the outer surface of the outer layer 21. An identification mark may be put on the identification tag.

The liner 30, defining a head pocket 11 within the head protection part 10 for receiving and protecting the head 101 of a golf club 100, is provided fully within the cavity of the head cover defined by the cushionable sponge 22 sewn to the outer layer 2, so as to tightly hold the club head 101 within the head pocket 11. Although the liner 30 may be made of knit cloth, it also may be made of the same woven fabric or synthetic fabric as for the outer layer 21.

An elastic band loop 40 is provided at the liner 30 to be tightened around the neck 102 of the golf club 100. In such a case, the liner 30 consists of the upper and lower parts. The upper and lower parts of the liner 30 are integrated into a single structure with an elastic band loop 10 interposed between said upper and lower parts.

The circumferential surface of the liner 30 may be divided into a plurality of sections. The elastic band loop 40 may be positioned within at least one of the sections.

The elongated shaft protection part 50 extends from the bottom end of the liner 30 and is attached to the bottom end of the head protection part 10 at its top end. The shaft protection part 50 is made of knit cloth, the woven fabric, or synthetic fabric, as in the case of the liner 30.

In FIG. 6, a longitudinal sectional view, showing the universally usable head cover of the embodiment in use is illustrated.

With reference to the drawing, the operation of the universally usable head cover of the embodiment will be described in the following.

When a golf club is inserted into the a head pocket 11 defined by the liner 30, the elastic band loop 40 is extended to receive the head 101 of a golf club 100. Since the band loop 30 is made of elastic material, the liner 30 is capable of receiving a head 101 of a golf club 100 regardless of its type and its size.

On the other hand, the elastic band loop 30 is tightened around the neck 102 of a golf club 100 while the head 101 of the golf club 100 is in the upper part of the liner 30. Since the band loop 30 is made of elastic material and its normal diameter is smaller than any of the diameters of the necks of general golf clubs, the band loop 30 is capable of being tightened around the neck 102 of the golf club 100. As a result of being tightened around the neck 102 of a golf club 100, the head cover of this invention is prevented from being undesirably removed from the head 101 of a golf club 100.

As described above, the present invention provides a head cover for a golf club, more securely covering any kind of or any size of golf club head, reduced in the production cost, and convenient to the golfer in use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A universally usable head cover for wood clubs, comprising:

a rigid outer layer having a cavity for accommodating a head of the wood club;

a liner provided within said cavity for enclosing the head and protecting the head from damage;

said liner containing only one elastic band loop interposed between upper and lower portions of said liner for elastically holding the neck of the wood club; and at least one elongated shaft protection part for accommodating a shaft of said wood club, said shaft protection part extending from a bottom end of said outer layer and having a passage for guiding the head of said wood club into said cavity.

* * * * *